US009994781B2

(12) United States Patent
Zimmermann

(10) Patent No.: US 9,994,781 B2
(45) Date of Patent: Jun. 12, 2018

(54) PROCESS AND SYSTEM FOR OBTAINING CRUDE OIL PRODUCTS

(71) Applicant: Linde Aktiengesellschaft, München (DE)

(72) Inventor: Heinz Zimmermann, München (DE)

(73) Assignee: Linde Aktiengesellschaft, Munich (DE)

( * ) Notice: Subject to any disclaimer, the term of this patent is extended or adjusted under 35 U.S.C. 154(b) by 0 days. days.

(21) Appl. No.: 15/307,474

(22) PCT Filed: Apr. 28, 2015

(86) PCT No.: PCT/EP2015/059249
§ 371 (c)(1),
(2) Date: Oct. 28, 2016

(87) PCT Pub. No.: WO2015/165920
PCT Pub. Date: Nov. 5, 2015

(65) Prior Publication Data

US 2017/0051213 A1 Feb. 23, 2017

(30) Foreign Application Priority Data

Apr. 30, 2014 (DE) ..... 10 2014 006 326
Sep. 11, 2014 (EP) ..... 14003149

(51) Int. Cl.
*C10G 9/00* (2006.01)
*C10G 55/04* (2006.01)
(Continued)

(52) U.S. Cl.
CPC ..... *C10G 55/04* (2013.01); *C10G 9/002* (2013.01); *C10G 9/36* (2013.01); *C10G 47/00* (2013.01); *C10G 69/06* (2013.01)

(58) Field of Classification Search
CPC ..... C10G 55/04; C10G 9/002; C10G 9/36; C10G 47/00; C10G 69/06
See application file for complete search history.

(56) References Cited

U.S. PATENT DOCUMENTS

2007/0055087 A1 3/2007 Powers
2008/0221378 A1* 9/2008 Stell ..... C10G 9/002 585/804

(Continued)

FOREIGN PATENT DOCUMENTS

WO 2010117401 A 10/2010

OTHER PUBLICATIONS

PCT/EP2015/059249 English Translation of the International Search Report and Written Opinion, dated Jul. 20, 2015, 9 pages.

*Primary Examiner* — Randy Boyer
*Assistant Examiner* — Juan C Valencia
(74) *Attorney, Agent, or Firm* — Lathrop Gage LLP

(57) ABSTRACT

A method for obtaining crude oil products is proposed in which a gaseous stream (d) is formed from a crude oil stream (b) by evaporation (2) and the gaseous stream (d) is at least partially subjected to a steam cracking process (1), a cracked gas stream (e) being produced in the steam cracking process (1) which is at least partially quenched with a liquid hydrocarbon stream (f), thereby forming a quenching effluent (g). It is provided that a fraction (f) of the crude oil stream (b) that remains liquid during the evaporation (2) of the crude oil stream (b) is used at least partly to form the liquid hydrocarbon stream (f) used for the quenching. The liquid hydrocarbon stream used for the quenching is low in or free from components that have been separated from the quenching effluent (g) or a stream formed from the quenching effluent (g) and the quenching effluent (g) is obtained by quenching with the liquid hydrocarbon stream (f) at a temperature in the range from 0 to 250° C. The invention also relates to an apparatus (100) configured to carry out the method.

8 Claims, 2 Drawing Sheets

(51) Int. Cl.

| | |
|---|---|
| ***C10G 47/00*** | (2006.01) |
| ***C10G 69/06*** | (2006.01) |
| ***C10G 9/36*** | (2006.01) |

(56) References Cited

U.S. PATENT DOCUMENTS

| | | | |
|---|---|---|---|
| 2009/0050523 | A1 | 2/2009 | Halsey |
| 2010/0320119 | A1 | 12/2010 | Ou |

* cited by examiner

PROCESS AND SYSTEM FOR OBTAINING CRUDE OIL PRODUCTS

The invention relates to a method and an apparatus for obtaining crude oil products according to the pre-characterising clauses of the independent claims.

PRIOR ART

In known refinery processes, crude oil is first desalinated and after heating is subjected to fractional distillation at atmospheric pressure (hereinafter referred to as atmospheric distillation). The so-called atmospheric residue remaining is subjected to vacuum distillation.

However, not all the fractions obtained during atmospheric distillation and vacuum distillation can be profitably utilised. Some of the compounds contained therein may therefore be catalytically reacted, for example, and valorised in this way. However, this is not always completely successful. Thermal reaction of crude oil components by steam cracking is also known.

The invention sets out to solve the problem of improving the corresponding processes and apparatus and in particular of increasing the yield of high-value crude oil products.

DISCLOSURE OF THE INVENTION

This problem is solved by a method and an apparatus according to the features of the independent claims. Embodiments are the subject of the respective sub-claims and the specification that follows.

For the terminology used and the technical details of the methods used, reference may be made to the relevant specialist literature (cf. for example Zimmermann, H. and Walzl, R.: Ethylene, In: Ullmann's Encyclopedia of Industrial Chemistry, Weinheim: Wiley-VCH, Online publication 2007, DOI: 10.1002/14356007.a10_045.pub2, and Irion, W. W. and Neuwirth, O. S.: Oil Refining, In: Ullmann's Encyclopedia of Industrial Chemistry, Weinheim: Wiley-VCH, Online publication 2000, DOI: 10.1002/14356007.a18_051).

Steam cracking processes are generally carried out using tube reactors the reaction tubes of which, the so-called coils, can be operated individually or in groups under identical or different conditions. Reaction tubes or sets of reaction tubes operated under identical or comparable conditions and possibly also tube reactors as a whole, operated under uniform conditions, are hereinafter referred to as "cracking furnaces". A cracking furnace in the terminology used here is thus a construction unit used for steam cracking in which identical or comparable reaction conditions prevail. A steam cracking apparatus may comprise one or more cracking furnaces.

By a cracked gas stream is meant here a gaseous stream which is formed from the effluent from one or more cracking furnaces. The cracked gas stream (also known as cracker effluent in English) is typically cooled, in a first cooling step, in a cracked gas cooler, for example a linear cooler (in English, a Transfer Line Exchanger, TLE) with coolant water and then cooled in a second cooling step by quenching, i.e. mixing with a liquid hydrocarbon stream.

In the specialist literature, the first cooling step, i.e. the cooling of the cracked gas with coolant water, for example in the cracked gas cooler, is sometimes also referred to as quenching. In this first cooling step, however, the cracked gas is only indirectly cooled and not mixed with a liquid hydrocarbon stream as in the second cooling step. The second cooling step may therefore also be referred to as the oil quench, to differentiate it more clearly. The stream formed by combining the cracked gas stream with the liquid stream used for the quenching is referred to here as the quenching effluent. The "quenching effluent" comprises all compounds from the liquid stream used for quenching and aöll compounds from the stream of cracked gas, which are at best reduced by reaction products resulting from the quench. Particularly, the mass flow of the quenching effluent corresponds to the sum from the mass flow of the liquid stream used for quenching and the mass flow of the stream of the cracked gas, it is, consequently, not the product of a separation or precipitation process. The quenching effluent is present immediately after the unification of the liquid stream used for quenching and the stream of the cracked gas.

Advantages of the Invention

The invention proposes a method for obtaining crude oil products in which a gaseous stream is formed from a crude oil stream by evaporation and the gaseous stream is at least partially subjected to a steam cracking process. In the steam cracking process, a cracked gas stream is produced. Corresponding processes are known, for example, from US 2008/0221378 A1 and WO 2010/117401 A1.

Within the scope of the present invention, at least some of the gaseous stream formed during the evaporation of the crude oil can be fed into one or more cracking furnaces, on its own or after being combined with one or more additional streams, for example one or more recycle streams. If there are a plurality of cracking furnaces, these may also be supplied with different streams. As already known, the charging of the cracking furnaces takes place after the addition of steam in each case.

The cracked gas stream obtained is at least partially quenched with a liquid hydrocarbon stream, thereby forming a quenching effluent. The present invention proposes that a fraction of the crude oil stream that remains liquid during the evaporation of the crude oil stream be used at least partly to form the liquid hydrocarbon stream used for the quenching, the liquid hydrocarbon stream used for the quenching being low in or free from components that have been separated from the quenching effluent or from a stream formed from the quenching effluent. In addition, the quenching effluent is obtained by quenching with the liquid hydrocarbon stream at a temperature in the range from 0 to 250° C.

In other words, within the scope of the present invention, the liquid hydrocarbon stream used for the quenching is not formed using a recycle stream and no quenching circuit is used as known from conventional methods. In a quenching circuit of a conventional method, for example, a so-called oil column is used having two sections arranged one above the other. The quenching oil is added at the top of the lower section. The cracked gas stream is fed into a lower part of the lower section in counter current to the quenching oil. Heavy compounds contained in the cracked gas stream are dissolved or suspended in the quenching oil and at the same time the cracked gas stream is cooled. The quenching oil with any compounds that are dissolved or suspended therein is drawn off from the sump of the oil column, optionally processed, and fed back in at the top of the lower section of the oil column. In an upper section of the oil column, pyrolysis gasoline is added which is separated off in a subsequent water quenching and also partially circulated.

A disadvantage of conventional quenching circuits, however, is the ageing of the quenching oil. As a result of the frequent contacts with the hot cracked gas stream, the initially low-viscosity compounds are polymerised, and soot and tar or other viscous high-boiling compounds are formed. The quenching oil therefore conventionally has to be changed regularly and replaced by fresh quenching oil. The used quenching oil is practically worthless. By contrast, by virtue of the fact that it is low in or free from components that have been separated out of the quenching effluent or from a stream formed from the quenching effluent, the liquid hydrocarbon stream used for the quenching according to the present invention does not undergo any ageing processes, or hardly any, because the non-recycled compounds which it contains come into contact with the cracked gas stream only once. Because they make contact only once, there are no ageing reactions and the corresponding compounds can be transferred into product fractions which can still be utilised profitably.

The cracked gas stream leaves the radiation zone of the cracking furnace or furnaces at a temperature of typically 750 to 875° C. The cracked gas stream should be cooled as quickly as possible to prevent further reaction of the compounds formed, such as the formation of polymers, for example. If the linear coolers mentioned hereinbefore are used, these perform a considerable part of the cooling of the cracked gas stream. As mentioned in the article "Ethylene" in Ullmann's Encyclopedia of Industrial Chemistry referred to hereinbefore, the cracked gas stream conventionally enters the oil column at a temperature of about 230° C. and leaves it at a temperature of about 100° C. The great majority of the heat is carried away by the quenching oil. When a corresponding conventional oil quench is used, the temperature of the cracked gas is thus reduced from a temperature value in a first temperature range to a temperature value in a second temperature range, the temperature value in the second temperature range being about 130° C. lower than the temperature value in the first temperature range. When the process is carried out without the use of a linear cooler, the temperature difference between the temperature values is significantly higher.

From US 2008/0221378 A1, a process is known in which a non-evaporated fraction of a crude oil stream is used for preliminary quenching of a cracked gas stream which has been obtained by steam cracking an evaporated fraction of the crude oil stream. The preliminary quenching is carried out in order to crack any components which are present in the non-evaporated fraction but are still capable of being cracked by means of the heat of the cracked gas stream. The addition of the non-evaporated fraction to the cracked gas stream within the scope of the preliminary quenching therefore takes place while the cracked gas stream is still at a high temperature, typically 760 to 929° C. At the same time, the preliminary quenching reduces the temperature of the cracked gas stream only slightly, namely by typically not more than 111° C. Downstream of the preliminary quenching, the stream obtained is therefore still at a very high temperature which makes it necessary to carry out further quenching before further processing takes place. In other words, therefore, in the process according to US 2008/0221378 A1, the temperature of the cracked gas during the preliminary quenching is reduced from a temperature value in a first temperature range to a temperature value in a second temperature range, the temperature value in the second temperature range being at most 111° C. lower than the temperature value in the first temperature range. The temperature value in the second temperature range is at least 649° C.

By contrast, as a result of the quenching with the liquid hydrocarbon stream according to the invention, the quenching effluent is obtained, as already mentioned, at a temperature within the temperature range from 0 to 250° C. The temperature may particularly fall within a temperature range from 50 to 200° C. or from 50 to 150° C., i.e. at a temperature which is al so obtained in a conventional oil column, and which enables direct further processing of the quenching effluent. Advantageously, in this case, before being quenched with the liquid hydrocarbon stream, the cracked gas stream has already been cooled by means of a linear cooler, for example, to a temperature which is 50 to 200° C., for example 100 to 150° C., above the temperature of the quenching effluent and corresponds, for example, to the typical entry temperatures into an oil column in a conventional process. In this particularly preferred embodiment, the invention makes it possible to dispense with the use of additional quenching oil, particularly an oil circuit. There is no cause to do this, on the basis of US 208/0221378 A1, as this document teaches that the cracked gas stream has to have a high temperature in order to crack any compounds present in the unevaporated fraction of the crude oil stream. Simple quenching to low temperatures by means of this unevaporated fraction, however, would bring corresponding cracking reactions to a halt and it would not be possible to achieve a reasonable cracking yield. Therefore, it is essential for the effluent from the preliminary quenching to be at a high temperature and thus further quenching in the form of an oil circuit is indispensable.

As the quenching effluent contains a considerable amount of finely divided oil droplets from the liquid stream used for the quenching, as well as high-boiling components (oils, tars and the like), in conventional steam cracking processes the quenching effluent is first freed from such components in a so-called oil column. Only downstream of the oil column can a corresponding stream be supplied to the known separating stages in order to recover the hydrocarbon products from the cracked gas.

The present invention is now based on the idea of dispensing with an oil column of this kind, and of further processing the quenching effluent in the same way as in the conventional processing of crude oil, for example. This is possible because, as a result of the quenching with the fraction that remains liquid during the evaporation of the crude oil stream, or a corresponding proportion thereof, the quenching effluent only contains (heavier) components of the kind that are also found in conventional crude oil streams which are subjected to atmospheric distillation.

In contrast to conventional processes in which a quenching oil circuit is provided, within the scope of the present invention the liquid hydrocarbon stream used for the quenching is used only once. A major advantage of the proposed method is, therefore, that the quenching does not require an oil circuit in which the oil (i.e. the liquid hydrocarbon stream conventionally used for the quenching) is usually very greatly aged by chemical reactions, and in particular increases significantly in viscosity and thus loses much of its value. Within the scope of the present invention, ageing reactions of this kind are of no significance, for the reasons explained. Another advantage which arises from the omission of the oil circuit is that, for example, the heat recovery from the cracked gas which is conventionally carried out using expensive heat exchangers in the oil circuit is no longer required and the heat can be supplied directly, through the quenching effluent, to another consumer unit. The heat may for example be used to (pre-)heat the streams used in the atmospheric distillation. The liquid fraction remaining during evaporation of the crude oil stream may also be cooled before use and its heat may be transferred to other streams.

Therefore, it is particularly advantageous within the scope of the present invention, if at least some of the quenching effluent is used to form a separation feed which, together with another crude oil stream, is separated by distillation to produce distillation effluents. This distillative separation is advantageously carried out initially in a distillation column configured for fractional distillation at atmospheric pressure, as used in conventional refinery equipment. The atmospheric distillation may be followed by vacuum distillation in a distillation column configured for this purpose. All the streams (cuts, fractions) formed during distillation (for example atmospheric distillation and/or vacuum distillation) are referred to here as distillation effluents.

The separation feed may be formed from the quenching effluent in any desired manner but always contains hydrocarbons having one, two, three, four or more carbon atoms contained in the quenching effluent, and/or hydrocarbons formed from such hydrocarbons, for example by hydrogenation or further reaction after quenching. These may be, for example, methane, ethane, ethylene, acetylene, propane, propylene and methylacetylene and saturated and unsaturated hydrocarbons with four carbon atoms. The "formation" of the separation feed as discussed may be carried out for example by separating off a partial stream, combining it with another stream or by chemical and/or physical reaction.

Moreover, the separation feed advantageously contains hydrocarbons which were previously present in the liquid hydrocarbon stream used for quenching, or compounds formed from such hydrocarbons. These are typically hydrocarbons with more than ten or 20 and for example up to 30 or more carbon atoms. Hydrocarbons of this kind thus advantageously do not need to be separated from the quenching effluent but according to an advantageous embodiment of the process are subjected, more particularly unchanged, to joint distillative separation together with the second crude oil stream.

In other words, an embodiment is proposed in which joint distillative separation of the quenching effluent is carried out together with the second crude oil stream. In this way, as explained hereinafter, full integration into a refinery is achieved, for example by feeding the whole of the quenching effluent into atmospheric distillation in a suitably configured distillation column together with the second crude oil stream. This makes it possible to do away with separate separating devices for hydrocarbons in the steam cracking stream or the quenching effluent. For example, the quenching effluent may be transferred, together with the liquid hydrocarbon stream used for the quenching, into a corresponding distillation column in which the conventional crude oil fractions are obtained. The compounds contained in the liquid hydrocarbon stream used for the quenching go over into the respective fractions, for example vacuum gas oil or atmospheric gas oil, depending on their boiling point. There is thus no need for any further separation of the compounds contained in the liquid hydrocarbon stream used for the quenching in the manner of a conventional oil column. Water quenching can also be omitted, as pyrolysis gasoline also goes over into the corresponding fractions of the crude oil distillation, namely the gasoline fractions. Separate compaction of the quenching effluent is not necessary either.

The process can therefore be implemented with significantly less expenditure on apparatus than a process according to the prior art, as described for example in US 2009/0050523 A1, wherein only heavy fractions separated from a cracked gas in the conventional manner are fed into a refinery process. Starting from US 2009/0050523 A1, the process according to the invention is not obvious as the quenching oil and pyrolysis gasoline circuit used in US 2009/0050523 A1 requires the separation of quenching oil and pyrolysis gasoline. Sending corresponding compounds in a quenching effluent for joint separation with a second crude oil stream is therefore not possible there. The same is also true with regard to a process as shown for example in US 2007/0055087 A1. US 2010/0320119 A1 discloses a process in which a quenching effluent is subjected to primary fractionation, resulting in the production of different streams. However, as US 2010/0320119 A1 explicitly teaches the preparation of a stream of tar from the primary fractionation and its use in a quenching oil circuit, it is not possible to feed a second crude oil stream into the primary fractionation, as this would make it impossible to recover the tar stream because of the additional crude oil components fed in.

In other words, in an advantageous embodiment, the present invention proposes initially processing the separation feed formed using the quenching effluent, like conventional crude oil streams, by atmospheric distillation. In atmospheric distillation, the products of the steam cracking process, for example ethylene and other light hydrocarbons, go over into the overhead stream of the distillation column. At the same time, the conventional cuts or fractions of the crude oil stream (and of the liquid stream used for the quenching) can be produced in this distillation column.

Within the scope of this preferred embodiment of the present invention, the oil column conventionally used in a steam cracking process and the distillation column for atmospheric distillation used in a conventional refinery process are thus functionally combined. The products of the steam cracking process drawn off from the top or from an upper part of the column for atmospheric distillation may be subjected, together with corresponding light products from the crude oil stream, if present, to the steps that normally follow on from the oil column of a steam cracking process, in order to prepare the cracked gas.

For example, a water wash may initially be used, in which any naphtha still contained in a corresponding stream is precipitated in liquid form. After the water wash, typically hydrocarbons with one to four carbon atoms still remain in the gaseous phase. These may subsequently be subjected to known separation sequences (Demethanizer First, Deethanizer First, etc.; for details, reference may be made to the specialist literature cited).

The further distillation effluents produced in the atmospheric distillation column are composed of heavier hydrocarbons which predominantly originate from the uncracked crude oil or the liquid stream used for quenching. These may be, for example, so-called atmospheric gas oil (AGO) and the atmospheric residues mentioned previously.

Additional advantages can be obtained if certain hydrocarbons, for example those contained in the cracked gas or in the additional crude oil stream, are subjected to the steam cracking process again. Streams of this kind subjected once again to the steam cracking process are referred to as recycle streams. Recycle streams may be combined and fed in to identical or different cracking furnaces together or separately from one another, optionally together with fresh feeds. The fresh feed used within the scope of the present invention is the gaseous stream formed during evaporation of the crude oil stream, as explained earlier, but it is also possible to use other streams supplied from the battery limits.

The separation of the fractions provided as recycle streams may be carried out, for example, in the conventional separators which are provided within the scope of the present invention, in the same way as in conventional steam cracking processes. Therefore, there is no need for distinct separation of corresponding light components, as conventionally occurs in a refinery. Volatile components of this kind do not have to be stored in tanks as in conventional refinery apparatus, because they can be fed into the steam cracking process as recycle streams. As is also explained hereinafter, the compounds contained in corresponding streams may also be at least partly further reacted.

Overall, the measures according to the invention have the advantage that there is no need for an oil column and that no pyrolysis oil and no pyrolysis gasoline are obtained as separate products. The compounds that conventionally go over into the pyrolysis oil and the pyrolysis gasoline are found in the corresponding distillation effluents (for example from the atmospheric distillation and the vacuum distillation) when the process according to the invention is used.

By recycling all the distillation effluents that are not wanted as products, the method according to the invention may also be configured so that typical refinery products such as petrol, diesel, heating oil, etc., are no longer produced. The above-mentioned components may be used as feedstock for the steam cracking process, for example after suitable treatment such as hydrotreating or (mild) hydrocracking, together or separately. In such a case, exclusively ethylene, propylene, butadiene, aromatic compounds and pressurised steam or electricity may be obtained from the crude oil put in, for example. This variant proves to be exceptionally economical. The process according to the invention can be flexibly adapted to the particular requirements of various compounds.

The present invention also makes it possible to utilise the waste heat produced in a steam cracking process particularly effectively. This heat can be used first of all to preheat the crude oil stream, the evaporated portion of which is subsequently subjected to the steam cracking process. Other waste heat can be used for example to heat the additional crude oil stream which is subsequently fed into the distillation column for atmospheric distillation. Overall, this results in an advantageous energy integration and a reduction in the waste heat that has to be removed. The cracked gas cooler may also be integrated in a corresponding heat recovery circuit, for example using steam produced therein to heat the crude oil stream.

The distillative separation of the separation feed formed using the quenching effluent together with the additional crude oil stream is advantageously carried out, as explained, at atmospheric pressure to begin with and then under a vacuum, so that the distillation can be carried out using known methods of refinery technology and corresponding methods of treating the distillation effluents can also be used.

As already mentioned, the distillation effluents or streams derived therefrom are at least partially also subjected to the steam cracking process. Secondary streams can be formed for example by branching off a partial stream, combining with other streams, chemically or physically reacting at least some components in corresponding streams, heating, cooling, evaporating, condensing, etc.

Particularly advantageously, corresponding secondary streams may be formed by hydrocracking processes. In these processes, the distillation effluents are wholly or partially catalytically hydrogenated and at least partially cracked, optionally after having previously been further separated and/or prepared. In this way, unsaturated hydrocarbons which are not wanted as furnace feeds may be converted into saturated hydrocarbons and reacted again in the steam cracking process to form high-value products.

The recycle streams may be, in particular, atmospheric gas oil (AGO) treated by hydrotreating and/or hydrocracking, and vacuum gas oil (VGO) treated by hydrotreating and/or hydrocracking, i.e. distillation residues from the atmospheric distillation or vacuum distillation. Other recycle streams may comprise unsaturated hydrocarbons with two to four carbon atoms and/or hydrocarbons with five to eight carbon atoms. Naphtha may also be used again in corresponding steam cracking processes.

In separation steps to which hydrocarbons with two to four carbon atoms are subjected following the distillative separation, compounds such as methane, ethylene, propylene, butadiene and/or aromatic compounds (benzene, toluene and/or xylenes, referred to jointly as BTX) may be obtained, for example, and removed from the apparatus. The vacuum residue which is produced during vacuum distillation and is of no further use and/or the methane formed can be burned to recover energy.

An apparatus for producing crude oil products which is configured to form a gaseous stream from a crude oil stream by evaporation and to subject the gaseous stream at least partially to a steam cracking process is also the subject of the present invention. The apparatus is configured to produce a cracked gas stream in the steam cracking process, which can be quenched with a liquid hydrocarbon stream at least partially to produce a quenching effluent. According to the invention, means are provided which are configured to use a fraction of the crude oil stream which remains liquid during evaporation of the crude oil stream at least partially to form the liquid hydrocarbon stream used for the quenching. The liquid hydrocarbon stream used for the quenching is low in or free from components that have been separated from the quenching effluent or from a stream formed from the quenching effluent. In addition, the quenching effluent is obtained by quenching with the liquid hydrocarbon stream at a temperature in the range from 0 to 250° C.

An apparatus of this kind comprises all the means that make it capable of performing a process according to the invention. Advantageously, the apparatus according to the invention comprises at least one distillation column configured for fractional distillation at atmospheric pressure and means that are configured to supply this distillation column with a separation feed formed using at least part of the quenching effluent and another crude oil stream.

Advantageously, means are also provided which are configured to at least partially subject distillation effluents formed in this distillation column, or streams derived therefrom, to the steam cracking process as well.

The invention is explained in more detail with reference to the attached drawings which show preferred embodiments of the invention.

BRIEF DESCRIPTION OF THE DRAWINGS

In the Figures, elements corresponding to one another have been given identical reference numerals and are not repeatedly explained. The components of the apparatus shown simultaneously correspond to steps of a process.

EMBODIMENTS OF THE INVENTION

Figure 1:
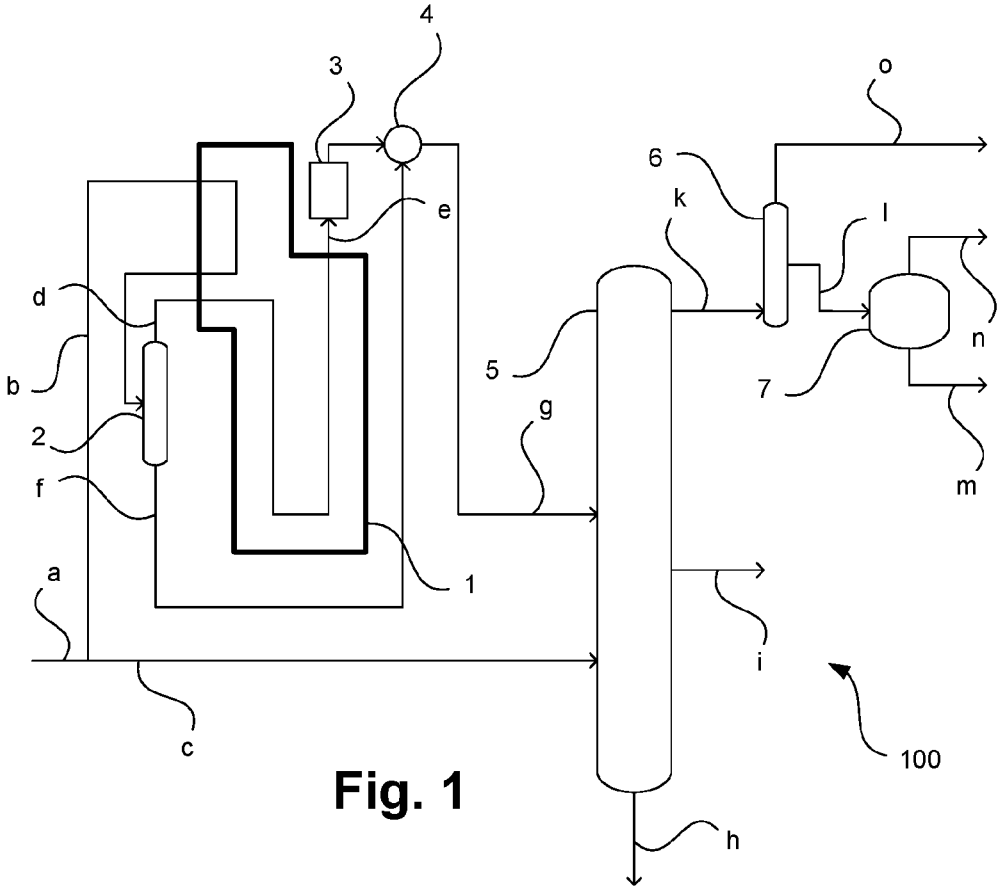
FIG. 1 shows an apparatus for recovering crude oil products according to one embodiment of the invention, in partial view.

FIG. 1 schematically shows, in partial view, an apparatus, generally designated 100, for producing crude oil products according to one embodiment of the invention.

Crude oil a supplied to the apparatus 100 is divided into two crude oil streams b and c. The crude oil stream b is preheated in a convection zone of one or more cracking furnaces 1 and transferred into an evaporation vessel 2. A portion of the crude oil stream b which evaporates in the evaporation vessel 2 is passed, as stream d, after mixing with steam, through the radiation zone of the cracking furnace or furnaces 1, and a cracked gas e is obtained.

The cracked gas e is cooled in a cracked gas cooler 3 and then quenched in a quenching device 4 with a portion of the crude oil stream b, illustrated here by the stream f, which has remained liquid in the evaporation vessel 2. A separation feed (not specifically shown) formed from the quenching effluent g is transferred into a distillation column 5 for fractional atmospheric distillation, into which the crude oil stream c is also fed.

The distillation column 5 is operated in the conventional manner, so that, for example, an atmospheric residue h and an atmospheric gas oil i are obtained therein. From the top, or from an upper part of the distillation column 5, a stream k is drawn off which contains light products from the cracking furnace or furnaces 1 and the crude oil stream c. By the admixture of water (not shown) in a water washer 6, a water-naphtha mixture is precipitated from the stream k and transferred as stream I into a decanter 7. In this decanter, a water stream m and a naphtha stream n are obtained.

Fractions remaining in gaseous form in the water washer 6, which are essentially hydrocarbons with one to four carbon atoms, are drawn off as stream o and fed into a fractionation section which may be of known configuration. In a corresponding fractionation section, for example, first of all methane and/or methane and ethane may be separated off (so-called Demethanizer First or Deethanizer First process).

Figure 2:
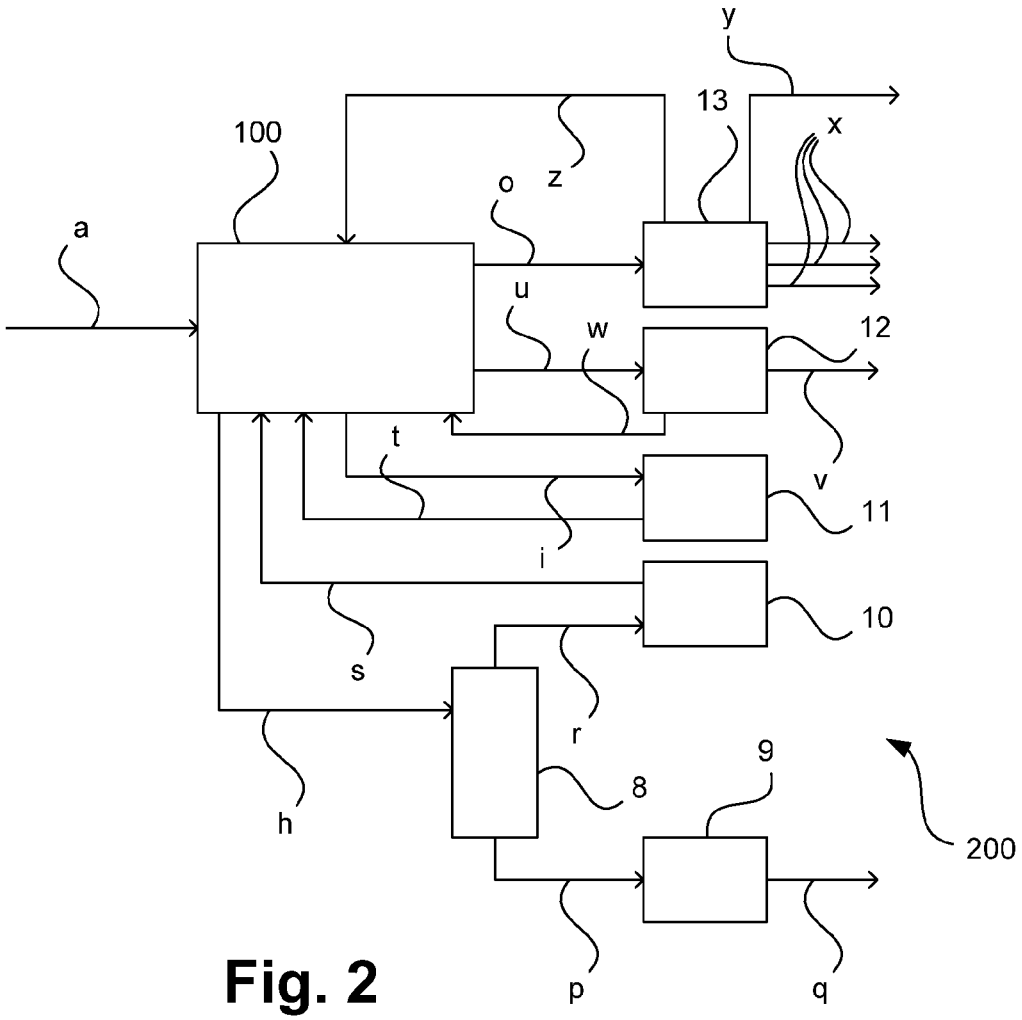
FIG. 2 shows an apparatus for recovering crude oil products according to one embodiment of the invention, in an expanded view.

FIG. 2 shows the apparatus 100 in expanded view, i.e. as an enlarged detail, generally designated 200, of a complete apparatus 100. The part of the apparatus shown in FIG. 1, i.e. at least one cracking furnace 1 with the associated devices 2 to 4 and a distillation column 5 configured for fractional atmospheric distillation, having a water washer 6 and an associated decanter 7, is designated 100.

As shown in FIG. 2, a vacuum residue p is obtained from an atmospheric residue which is drawn off from the distillation column 5 as stream h, in a distillation column 8 configured for vacuum distillation; this vacuum residue p can be burned in a device 9 and used to recover energy, as indicated by arrow q.

An overhead stream r from the distillation column 8, so-called vacuum gas oil, is transferred into a hydrogenation unit 10 where the stream r may be processed by hydrocracking, for example. A correspondingly processed stream s can be recycled into the steam cracking process or into one or more cracking furnaces 1. The same also applies to the above-mentioned stream i, the atmospheric gas oil, which can be treated in a hydrogenation unit 11 and then recycled as stream t into the steam cracking process. From a stream u, which essentially contains hydrocarbons having five to eight carbon atoms, aromatic compounds can be separated off in an aromatics extraction unit 12 and discharged from the apparatus as stream v. A remaining fraction can be subjected to another steam cracking process as stream w. The stream o described hereinbefore, which predominantly comprises hydrocarbons having one to four carbon atoms, can be transferred into a C4 fractionation section 13 in which the product streams which are here generally designated x, such as ethylene, propylene and butadiene, for example, can be separated off. A methane stream y can be discharged from the apparatus and/or used for heating. Hydrocarbons not obtained as product streams x may be recycled into the steam cracking process as stream z.

The invention claimed is:

1. Method for obtaining crude oil products wherein a gaseous stream (d) is formed from a crude oil stream (b) by evaporation and the gaseous stream (d) is at least partly subjected to a steam cracking process (1), wherein, in the steam cracking process (1), a cracked gas stream (e) is produced which is at least partly quenched with a liquid hydrocarbon stream (f), with formation of a quenching effluent (g), characterised in that a fraction (f) that remains liquid during the evaporation (2) of the crude oil stream (b) is at least partly used to form the hydrocarbon stream (f) using for quenching, wherein the liquid hydrocarbon stream used for the quenching is low in or free from components that have been separated from the quenching effluent (g) or a stream formed from the quenching effluent (g) and the quenching effluent is obtained by quenching with the liquid hydrocarbon stream (f) at a temperature in the range from 0 to 250° C.

2. Method according to claim 1, wherein a separation feed is formed from at least part of the quenching effluent (g) and is separated (5, 8) by distillation together with a further crude oil stream (c), thereby forming distillation effluents (h, i, k, p, r).

3. Method according to claim 2, wherein the distillation effluents (h, k, p, r) or streams (s, t, w, z) derived therefrom are at least partly subjected to the steam cracking process (1) as recycle streams.

4. Method according to claim 2, wherein the distillative separation (5, 8) of the separation feed together with the further crude oil stream (c) is carried out initially at atmospheric pressure (5) and subsequently under vacuum (8).

5. Method according to claim 3, wherein at least streams (s, t) derived by catalytic hydrogenation (10, 11) are formed from at least a proportion of the distillation effluents (i, r).

6. Method according to claim 3, wherein atmospheric gas oil (i) treated by catalytic hydrogenation (11), vacuum gas oil (r) treated by catalytic hydrogenation, saturated hydrocarbons having two to four carbon atoms (z) and/or hydrocarbons having five to eight carbon atoms (w) are used as recycle streams.

7. Method according to claim 2, wherein methane, ethylene, propylene and/or butadiene (x) and/or aromatic compounds (v) are obtained.

8. Method according to claim 2, wherein at least a proportion of the distillation effluents (p, y) is burned to recover energy.

* * * * *